US009926660B2

(12) United States Patent
Schulze et al.

(10) Patent No.: US 9,926,660 B2
(45) Date of Patent: Mar. 27, 2018

(54) WASHING MACHINE AND METHOD FOR TREATING LAUNDRY USING FOAM

(75) Inventors: Ingo Schulze, Panketal (DE); Harald Moschütz, Grossbeeren (DE)

(73) Assignee: BSH Hausgeräte GmbH, Munich (DE)

( * ) Notice: Subject to any disclaimer, the term of this patent is extended or adjusted under 35 U.S.C. 154(b) by 415 days.

(21) Appl. No.: 12/665,774

(22) PCT Filed: Jun. 11, 2008

(86) PCT No.: PCT/EP2008/057285

§ 371 (c)(1),
(2), (4) Date: May 28, 2010

(87) PCT Pub. No.: WO2008/155272

PCT Pub. Date: Dec. 24, 2008

(65) Prior Publication Data

US 2010/0242184 A1 Sep. 30, 2010

(30) Foreign Application Priority Data

Jun. 20, 2007 (DE) ..... 10 2007 028 213

(51) Int. Cl.
*D06F 35/00* (2006.01)
*D06F 17/12* (2006.01)

(52) U.S. Cl.
CPC ..... *D06F 35/006* (2013.01); *D06F 17/12* (2013.01)

(58) Field of Classification Search
CPC ..... D06F 35/006; D06F 17/12
USPC ..... 68/5 R, 6, 7, 12.21, 12.22, 59, 84, 139, 68/900
See application file for complete search history.

(56) References Cited

U.S. PATENT DOCUMENTS

| | | | | |
|---|---|---|---|---|
| 4,499,620 | A | 2/1985 | Minagawa | |
| 4,714,479 | A * | 12/1987 | Wilsberg | 8/137 |
| 5,253,380 | A | 10/1993 | Lim et al. | |
| 5,295,373 | A * | 3/1994 | Lim et al. | 68/12.05 |
| 6,662,600 | B1 | 12/2003 | Field et al. | |
| 2003/0074932 | A1 * | 4/2003 | No et al. | 68/58 |
| 2004/0040344 | A1 * | 3/2004 | Minayoshi et al. | 68/12.16 |
| 2005/0125909 | A1 * | 6/2005 | Bellinetto et al. | 8/158 |
| 2006/0048548 | A1 * | 3/2006 | Park et al. | 68/12.06 |
| 2008/0016626 | A1 * | 1/2008 | Oak et al. | 8/158 |
| 2008/0099052 | A1 | 5/2008 | Lee et al. | |
| 2008/0155760 | A1 * | 7/2008 | Hoppe | 8/159 |
| 2009/0064421 | A1 * | 3/2009 | Lee et al. | 8/137 |

FOREIGN PATENT DOCUMENTS

| | | | |
|---|---|---|---|
| BE | 643806 | A | 5/1964 |
| CN | 2256429 | Y | 6/1997 |
| CN | 1478943 | | 3/2004 |
| DE | 2907562 | A1 | 8/1980 |
| DE | 3042832 | A1 | 6/1982 |
| DE | 3528253 | A1 | 11/1986 |
| DE | 19624637 | * | 1/1998 |
| DE | 202005009445 | U1 | 9/2005 |
| EP | 0495168 | A1 | 7/1992 |
| GB | 625853 | A | 7/1949 |
| JP | 4272791 | A | 9/1992 |
| JP | 2000-051562 | * | 2/2000 |
| JP | 2001-198392 | * | 7/2001 |
| WO | 9749789 | A1 | 12/1997 |
| WO | 9937847 | A1 | 7/1999 |
| WO | WO 2001/002639 | A1 | 1/2001 |

OTHER PUBLICATIONS

Translation of DE19624637, Jan. 16, 2013.*
Machine translation JP 2000-051562.*
International Search Report PCT/EP2008/057285, dated Nov. 11, 2008.

* cited by examiner

*Primary Examiner* — Amina S Khan
(74) *Attorney, Agent, or Firm* — Nixon & Vanderhye P.C.

(57) ABSTRACT

A washing machine has a lye container, a lye drainage system disposed at a base of the lye container, a drive motor for a drum, and a heating unit. The washing machine has a device for supplying air into the lye, the device can be switched independently of the drum, and the device is an air compressor pump having an outlet to the lye container.

19 Claims, 1 Drawing Sheet

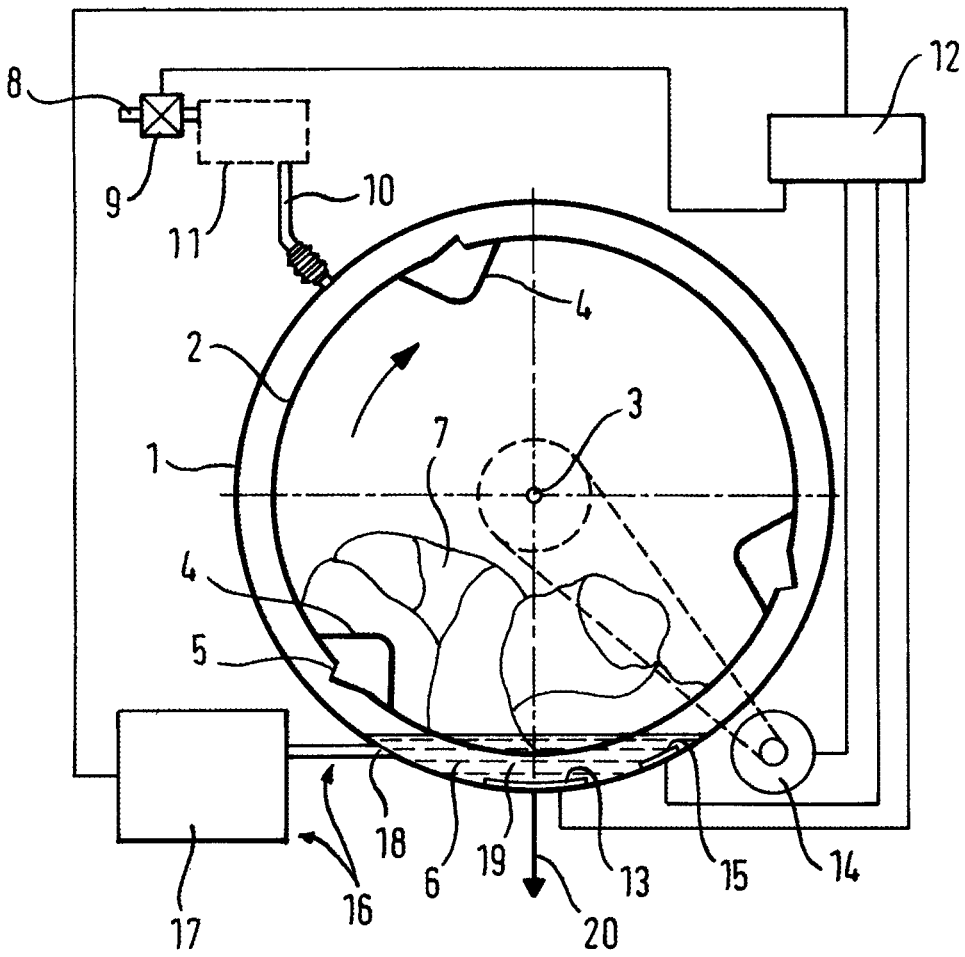
8
9
11
10
12
4
2
3
7
1
4
5
18
6
19
13
15
14
17
16
20

WASHING MACHINE AND METHOD FOR TREATING LAUNDRY USING FOAM

BACKGROUND OF THE INVENTION

Field of the Invention

The invention relates to a washing machine and a method for treating laundry using foam The mechanical processing of laundry items in a washing machine equipped with a drum is above all ensured by a cyclically repeating rise and fall of the washing items by way of laundry agitators arranged in the drum during rotation of the drum (laundry fall). An optimum so-called discharge parabola is generally determined here by adjusting a rotary speed of the drum. Mechanical energy is supplied at approximately 50 revolutions per minute in the case of a drum diameter in a front loading washing machine which is currently conventional in Europe. The configuration of a reversing rhythm, i.e. a cyclically repeating switchover of the direction of rotation of the drum enables the mechanical processing during washing to be extensively varied and adjusted.

Laundry items, such as high-quality textiles like wool, silk or lace, which react sensitively to mechanical processing, are particularly problematical during washing. The laundry fall of such laundry items is to be minimised particularly in the case of a large diameter of the drum. Such a laundry item is thus barely moved during the washing phase and is only partially drawn through the washing liquor by the drum not being completely rotated. Reference is also made here to a wool swing or wool scales. A satisfactory washing performance is however not achieved here as a result of the significantly restricted movement of the laundry item.

DE 196 24 637 A1 describes a method for mechanically washing textiles, in particular high-quality textiles, at temperatures of a maximum of 60° C., in which a) the washing machine is loaded with textiles b) by using a powdered to granular detergent with an apparent density of 300 to 1000 g/l across a rinsing apparatus in the washing machine or a dosing aid in a concentration of 2.5 to 8 g/l in the washing liquor, foam is generated which, when measured according to SSF methods known per se, fulfils the following stability criteria;

i) no holes occur in the foam column with samples in the useful concentration range from 2.5 to 8 g/l (water hardness 16° d, temperature 16° C.);

(ii) the foam column has a height of at least 30 cm and at the most 40 cm after 120 seconds foaming time;

(iii) the theoretical foam height after the application of a 50 g weight is no less than 28 cm, where the difference between the maximum foam height after 120 seconds foaming time and the theoretical foam height is less than 4.3 cm, and/or (iv) the drop in the foam height per time unit after the application of the weight is less than 2 cm per minute;

c) and the textiles are gently washed in this foam

DE 35 28 253 A1 discloses a method and a device for washing laundry, in particular a method for washing laundry in a washing machine by introducing ambient air into the washing licor and a washing machine with a rotatable drum and a fan, an air duct guided past the highest achievable water state and a blast connection arranged along the base of the lye container. Ambient air is forced into the lye container way of a fan, with this ambient air passing herein through the holes in the drum.

DE 29 07 562 A1 describes a method for increasing the cleaning effect of washing machines as well as washing machines for implementing the method. In particular, a method for increasing the cleaning effect of drum washing machines is disclosed, in which the laundry is mechanically moved in a solution and air, which is oscillated at a low frequency, is supplied to the solution in a finely distributed fashion. A washing machine for implementing this method has a lye container arranged in a housing and devices for moving the laundry within the lye container, with a membrane air pump being mounted in the housing, said membrane air pump conveying air through at least one nozzle hood, which finely distributes the air, by way of a mechanical oscillations, said nozzle hood being arranged in the interior of the lye container below the lye mirror.

U.S. Pat. No. 5,295,373 discloses a washing machine with a drum and a lye container, with a bubble generator being located in the latter and connected to an air pump. With the described method, a formation of bubbles in portions and the prompt removal thereof, before new bubbles enter the drum, is of great importance. A specially embodied bubble generator is therefore arranged in a lower region between the drum and the lye container.

BE 643 806 A describes a washing method in a drum washing machine, in which laundry is treated with a turbulent washing liquor at a temperature of above 95° C. Air is introduced below the drum in order to contribute to an intensive movement and reduction in the foam formation at this temperature.

WO 99/37847 A relates to a method and a device for cleaning articles. The device, which can be a washing machine or a dishwasher, includes an at least partially closeable space for receiving the articles to be cleaned and means for providing a cleaning fluid for the space, with means for providing a gas for the space being available, which assist with the cleaning process. In one embodiment, a gas is preferably made available at a higher pressure than that of the atmospheric pressure. The air introduced into the washing machine is used for the purpose of mechanically assisting with the cleaning process.

BRIEF SUMMARY OF THE INVENTION

The object of the present invention is thus to provide a washing machine and a method for gently treating laundry, in which the effects of the mechanics of the washing process are minimal, with the washing machine and the method being suited in particular to treating sensitive laundry items made of high-quality textiles such as wool, silk or lace.

In accordance with the invention, this object is achieved by a washing machine with the features of claim 1 and by a method with the features of claim 7. Preferred embodiments of the invention are detailed in the respectively dependent claims. Preferred embodiments of the washing machine correspond to preferred embodiments of the method, even if they are not referred to here in detail.

The invention thus relates to a washing machine for in particular gentle treatment of laundry with foam from a solution with a drum rotatably mounted in a lye container, a lye drainage system arranged on the base of the lye container, a drive motor for the drum and a heating facility, with the washing machine having a device for supplying air into the lye, said device being switchable independently of the drum and the device for supplying air being an air compressor pump with an output to the lye container.

The outlet of the air compressor pump is preferably in a lower region between the drum and the lye container. Within the meaning of the invention, "lower region between the drum and the lye container" preferably refers to the region between the drum and the lye container, which is filled by the lye if this is present in the lye container in a quantity sufficient to touch the lower end of the drum.

The geometry of the foam can be optimised at the outlet of the air compressor pump by way of the constructive configuration of an air outlet, with a pore size between a fine pored and a rough pored foam being adjusted. A fine pored foam generally has a better cleaning effect since it can permeate into laundry more easily.

In a further preferred embodiment of the inventive washing machine, an additional structural design of the drum is provided, which is provided to assist with a formation of foam. This preferably concerns a laundry agitator, which is optimised in respect of the supply of air. It is apparent that a plurality of such laundry agitators, in particular a number of three or four, is further preferred.

The afore-cited laundry agitator may be cast into the drum as an integral component or inserted into the drum as an additional component. It is also representative of a plurality of embodiments for the structural configuration, which is in particular also conceivable as an arrangement of particular fins or as a helical wound configuration of an interior part of the drum.

The device for supplying air into the solution can preferably be controlled by a corresponding control path, which includes in particular a control facility of the washing machine. A controllable supply of air into the solution is thus possible. Aside from the possibility of a constant air supply, which can only be switched on and off, a continual or gradual variation in the quantity of supplied air can be provided here.

A washing machine generally has switching means for rotating and stopping the drum. Moreover, an inventive washing machine preferably comprises a sensor for determining a quantity of liquid disposed in the lye container or a foam as a component of the said control path.

It is possible to determine the filling of the drum with foam by means of a suitable sensor. A conventional sensor for determining the water level can be used as a sensor for determining the quantity of liquid or foam disposed in the lye container, the sensor signal of which is tracked during the process. Such a sensor generally measures a hydrostatic pressure p and/or a temporal gradient $(\Delta p/\Delta t)_1$ of the hydrostatic pressure p. The filling with foam generally presents a sudden pressure increase on the sensor.

One advantage of the invention relates to the laundry fall being limited by a shortening of the fall path for the laundry items. The inner region of the drum is largely filled with foam when treating laundry items with foam. When rotating the drum, the items of laundry thus fall directly into the established foam. As a result, the fall path is reduced and the kinetic energy of the laundry items when striking the foam is gently converted into the deformation and/or movement and heating of the foam. The surprisingly improved cleaning effect can be detailed by way of increasing the relative movement between the foam and laundry item. This results in an improvement when dissolving and removing dirt from the laundry item.

The invention also relates to a method for the particularly gentle treatment of laundry with a foam from a solution in a washing machine with a drum rotatably mounted in a lye container, a lye drainage system arranged on the base of the lye container, a drive motor for the drum, a heating device and a device for supplying air into the lye which can be switched independently of the drum, with the foam being generated by means of the device, by way of supplying air into the solution, the device being an air compressor pump and the air compressor pump supplying air into the solution by way of an outlet disposed in a lower region between the drum and the lye container.

With the inventive method, the foam generally fills a large part of the interior of the drum. With this method, the foam is preferably generated in a quantity which is sufficient for foam to be present in the drum up to a height of ⅓ to ⅔ of the interior diameter of the drum.

The inventive method functions particularly well if the solution has a detergent, which can produce a stable foam. A suitable detergent is described for instance in DE 196 24 637 A1.

A detergent is preferably used, which enables the formation of bubbles, the diameter of which is smaller than the diameter of openings in the drum and/or the laundry agitators disposed therein.

It is also possible to use an inventive washing machine, the laundry agitator of which and/or the interior of the drum of which has openings, which are larger than the diameter of bubbles generated with a detergent. It is in turn preferable here for the openings to be significantly larger than the diameter of the generated bubbles.

The foam can be generated if the drum is stationary. The drum is preferably rotated for a quick generation of a foam and the good distribution thereof within the drum at a suitable speed $U_2$, with it being advantageously possible for the direction of rotation to be changed.

The speed $U_2$ can vary widely. Preferably a speed $U_2$ in the range of 30 to 80, in particular 40 to 60, for instance 50 rotations per minute is used. In this way the existing dirt is removed from the fibers by milling and rubbing the laundry items against one another and the effect of the foam.

The foam can be generated at room temperature. The inventive method is however preferably implemented with a heated solution and/or by heating the solution.

With the inventive method, the laundry items are advantageously completely embedded in the foam.

Inventive washing machines and methods have significant advantages. The protection of sensitive laundry items such as wool, silk or lace during a washing process is significantly improved. Furthermore, the washing performance is improved so that an improved washing effect is achieved with an otherwise identical sequence of a washing program.

The invention is described in more detail below with reference to the exemplary embodiment illustrated in FIG. 1.

BRIEF DESCRIPTION OF THE SEVERAL VIEWS OF THE DRAWING

FIG. 1 shows a schematic representation of the parts of a washing machine which are relevant to the illustration, in which an inventive method can be implemented. Other embodiments are conceivable.

DESCRIPTION OF THE INVENTION

The washing machine in the embodiment shown in FIG. 1 has a lye container 1, in which a drum 2 is rotatably mounted and can be operated by a drive motor 14. The axis of rotation 3 of the drum 2 is directed upwards and forwards at a small angle (e.g.) 13° from the horizontal so that the interior of the drum 2 can be accessed and viewed more easily. An increase in the through flow force of the laundry 7 with foam is also achieved by this arrangement concurrently with specially molded agitators 4 and ladling devices 5 for the solution 6 on the interior surface of the drum casing.

The washing machine also has a lye supply system, which includes a water connection fitting for the mains water system 8, an electrically controllable valve 9 and a supply line 10 to the lye container 1, which can if necessary also be guided by way of a detergent rinsing device ("rinsing shell") 11, from which the supply water is able to transport detergent portions into the lye container 1. A heating device 13 is also disposed in the lye container 1. The valve 9, and also the heating device 13 are controlled by a control device ("program controller") 12 as a function of a program workflow, which is associated with a time program and/or with the achievement of certain measured values of parameters such as lye level, foam level, lye temperature, speed of the drum 2 and/or within the washing machine. A sensor 15 for measuring the hydrostatic pressure p in the lye container 1 is provided.

A lye drainage system 20, which, in accordance with conventional practice, includes a drainage valve and a lye pump in addition to corresponding lines, is only shown schematically for the sake of clarity.

A combination with an air compressor pump 17 is shown in the embodiment in FIG. 1 as a device 16 for supplying air into the solution, the outlet 18 of which protrudes in a lower region 19 between the drum 2 and the lye container 1.

The laundry agitators 4 are, as additional structural configurations of the drum 2, optimised to assist with a formation of foam, as described initially above.

In this washing machine, laundry items made of high-quality textiles can be gently cleaned using foam, with the method features and parameters being used, which are explained further above, whereupon reference is made hereto instead of a repetition.

The foam formation is controlled by way of a control path comprising the sensor 15 and the control facility 12, so that, be it as a result of alternating switching off and on of the compressor pump 17 or a variation in its output, the quantity of foam available for treating textiles is controlled and in particular also limited.

The invention claimed is:

1. A washing machine, comprising:

a lye container;

a drum in the lye container;

a foam generator adapted to generate a quantity of foam from a washing liquid in the lye container, wherein the foam washes items in the drum and wherein the washing liquid only touches a lowest end of the drum.

2. The washing machine of claim 1, wherein the foam generator comprises an air pump.

3. The washing machine of claim 1, wherein the foam generator has an outlet in a lower region between the drum and the lye container.

4. The washing machine of claim 1, wherein the washing machine includes at least one agitator adapted to assist with formation of foam.

5. The washing machine of claim 4, wherein the agitator has openings dimensioned to be larger than the diameter of bubbles in the foam.

6. The washing machine of claim 1, further comprising a sensor to determine a quantity of liquid and/or foam, and a controller set or programmed to control an amount of foam provided to the drum based on the sensor.

7. The washing machine of claim 6, wherein the sensor comprises a pressure sensor and wherein the controller is set to control the foam generator based upon a sudden pressure increase.

8. The washing machine of claim 1, wherein the drum is rotatable and the lye container is adapted to hold a quantity of liquid, the drum including a plurality of openings, and wherein the foam generator comprises an air compressor adapted to be in communication with the liquid in the lye container, whereby the foam from the lye container is guided to the drum via the openings.

9. The washing machine of claim 1, wherein the foam generator is adapted to generate the quantity of foam from the washing liquid in the lye container to fill the drum to a height of at least ⅓ of the interior diameter of the drum with the foam, the foam rising to a height that is above a height of the washing liquid such that a laundry item falls directly into the foam due to rotation of the drum.

10. A method for treating laundry in a washing machine including a lye container and a drum in the lye container, the method comprising:

providing a washing liquid to a height that touches but does not exceed a lowest end of the drum;

generating foam from the washing liquid in the lye container; and washing items in the drum container with the generated foam.

11. The method of claim 10, wherein the washing machine includes at least one agitator, and wherein the method includes assisting the formation of foam with the at least one agitator.

12. The method of claim 10, further comprising determining a quantity of liquid and/or foam, and controlling an amount of foam provided to the drum based on the determining.

13. The method of claim 10, wherein a height of the foam is controlled to be in a range of ⅓ to ⅔ an interior height of the drum.

14. The method of claim 13, further comprising determining one of a quantity of the washing liquid and the quantity of the foam, and controlling generation of the foam based upon the quantity of washing liquid and/or the quantity of the foam.

15. The method of claim 14, generation of the foam is based upon a sudden pressure increase.

16. The method of claim 10, wherein the drum is rotatable in the lye container and the drum including a plurality of openings, and wherein the method further comprises providing a source of compressed air to generate the foam in the lye container, and guiding the foam from the lye container to the drum via the openings.

17. The method of claim 10, further comprising discharging the foam to an outlet in a lower region between the drum and the lye container.

18. The method of claim 10, further comprising generating additional foam with an agitator on an inner surface of the drum.

19. The method of claim 10, wherein the foam is generated by an air pump.

* * * * *